US007497177B2

(12) United States Patent
Tanaka et al.

(10) Patent No.: US 7,497,177 B2
(45) Date of Patent: Mar. 3, 2009

(54) SEAM RAVEL PREVENTING APPARATUS AND RAVEL PREVENTING METHOD

(75) Inventors: Yoshiyuki Tanaka, Toyonaka (JP); Ryuichi Yokoyama, Toyonaka (JP); Osamu Yasuzawa, Toyonaka (JP)

(73) Assignee: Yamato Mishin Seizo Kabushiki Kaisha, Osaka-shi (JP)

( * ) Notice: Subject to any disclaimer, the term of this patent is extended or adjusted under 35 U.S.C. 154(b) by 299 days.

(21) Appl. No.: 11/398,652

(22) Filed: Apr. 6, 2006

(65) Prior Publication Data

US 2006/0231002 A1 Oct. 19, 2006

(30) Foreign Application Priority Data

Apr. 14, 2005 (JP) ..... 2005-117532
Aug. 25, 2005 (JP) ..... 2005-244854

(51) Int. Cl.
*D05B 65/00* (2006.01)
*D05B 57/00* (2006.01)

(52) U.S. Cl. ..... 112/292

(58) Field of Classification Search ..... 112/197, 112/165, 291, 292, 295, 296, 298, 475.17, 112/470.01; 83/910, 936
See application file for complete search history.

(56) References Cited

U.S. PATENT DOCUMENTS

| | | | | |
|---|---|---|---|---|
| 3,532,065 A | | 10/1970 | Marforio | 112/252 |
| 4,726,305 A | * | 2/1988 | Seto | 112/298 |
| 5,337,688 A | | 8/1994 | Arima | 112/298 |
| 5,722,338 A | | 3/1998 | Douyasu | 112/475.17 |
| 5,769,018 A | * | 6/1998 | Nakano | 112/475.17 |
| 6,119,613 A | | 9/2000 | Douyasu et al. | 112/475.17 |
| 6,263,813 B1 | * | 7/2001 | Toume et al. | 112/291 |
| 6,422,165 B1 | | 7/2002 | Tanaka et al. | 112/470.01 |

FOREIGN PATENT DOCUMENTS

| | | |
|---|---|---|
| JP | 9-225163 | 9/1997 |
| JP | 2879399 | 1/1999 |
| JP | 11-070281 | 3/1999 |
| JP | 2001-062167 | 3/2001 |
| JP | 2001-129283 | 5/2001 |
| SU | 281298 | 12/1970 |

OTHER PUBLICATIONS

Decision for Allowance of Registration dated Oct. 31, 2007 in Korean Patent Appln No. 10-2006-0033445 with English translation.

* cited by examiner

*Primary Examiner*—Ismael Izaguirre
(74) *Attorney, Agent, or Firm*—Kratz, Quintos & Hanson, LLP

(57) ABSTRACT

A looper is brought into an advance state at the end of sewing, and a looper thread hanging hook arranged on the right rear side of a needle drop position is forced to advance and retreat to catch a looper thread running to the rear side of the looper and hold it on the rear side of the needle drop position. After performing sewing for one stitch in this state, the thread cutting hook arranged on the right side of the needle drop position is forced to advance and retreat to catch the looper thread running to the rear side of the looper with a first hold section and catch needle threads and the looper thread held by the looper thread hanging hook with a second hook section, and then these threads are collectively cut by bringing them into slide-contact with a thread cutting knife.

6 Claims, 14 Drawing Sheets

SEAM RAVEL PREVENTING APPARATUS AND RAVEL PREVENTING METHOD

CROSS-REFERENCE TO RELATED APPLICATIONS

This non-provisional application claims priority under 35 U.S.C. §119(a) on Patent Application No. 2005-117532 filed in Japan on Apr. 14, 2005 and Patent Application No. 2005-244854 filed in Japan on Aug. 25, 2005, the entire contents of which are hereby incorporated by reference.

BACKGROUND OF THE INVENTION

1. Field of the Invention

The present invention relates to an apparatus that is provided in a sewing machine for performing sewing using a looper thread and needle threads, such as a multi-thread chain stitch sewing machine and a covering chain stitch sewing machine, to prevent raveling of a seam at the end of sewing, and also relates to a ravel preventing method implemented using this apparatus.

2. Description of Related Art

In a multi-thread chain stitch sewing machine and a covering chain stitch sewing machine, loops of needle threads 6*a* and 6*b* and a looper thread 7 are intertwined in an interlooping manner on the back side of sewn cloth, and a seam shown in FIG. 1A is formed. The seam formed in such a manner has the following problem. If an end of the looper thread 7 cut at the end of sewing is pulled as shown by an arrow in FIG. 1A, the looper thread 7 may slip out of the final loops 6*c* and 6*d* of the needle threads 6*a* and 6*b*, and may move consecutively toward the sewing start side and cause a ravel.

Conventionally, various kinds of methods for preventing such raveling and apparatuses for implementing such a method have been put into practice, and one example is the ravel preventing method and apparatus invented by the applicant of this application (see, for example, Japanese Patent No. 2879399). In this method and apparatus, there is provided a looper thread hanging hook for holding a looper thread, which is passed into the loops of needle threads by the advance of the looper, on the left advance end of the looper. After temporarily suspending sewing by bringing the looper into an advance state just before the end of sewing, the looper thread is put on the looper thread hanging hook. Then, after sewing for one stitch in this state, the needle threads and looper thread are cut.

According to this invention, as shown in FIG. 1B, there is formed a seam in which the looper thread 7 caught by the looper thread hanging hook is intertwined in an interlacing manner with the final loops 6*c* and 6*d* of the needle threads 6*a* and 6*b* formed before suspending the sewing. Since the looper thread 7 intertwined in such a manner will not slip out of the final loops 6*c* and 6*d* even when its end is pulled as shown by an arrow, it is possible to certainly prevent raveling of the seam at the stage of occurrence, and thus it is possible to provide a reliable ravel prevention effect. Moreover, the seam at the sewing end portion does not look differ from other portion as shown in FIG. 1B, and therefore does not deteriorate the appearance.

The ravel preventing method proposed in the publication of Japanese Patent No. 2879399 is an excellent method capable of certainly preventing raveling that may occur in the vicinity of the sewing end portion in a sewing machine, such as a multi-thread chain stitch sewing machine and a covering chain stitch sewing machine, which performs sewing using a looper thread and needle threads.

By the way, in an apparatus for implementing the above-mentioned ravel preventing method, the looper thread hanging hook for catching the looper thread is arranged on the rear side of a needle drop position, on the left advance end side of the looper that advances from the right to left side of the needle drop position, and advances or retreats in the forward and backward direction at this position to catch the looper thread on the rear side of the looper.

BRIEF SUMMARY OF THE INVENTION

However, in order to mount the looper thread hanging hook including a driving mechanism for advancing and retreating the looper thread handing hook, a large space is required on the rear side of the needle drop position that is set in the end portion of the sewing bed, and thus there is a problem that it is difficult to apply this structure to a sewing machine that comprises a small-diameter cylindrical bed to handle a cylindrical sewn product.

In order to reduce the mount space of the driving mechanism, some sewing machine has a structure in which the looper thread hanging hook for catching the looper thread on the rear side of the looper is arranged to swing around a vertical axis. In this structure, however, since a swing axis of the looper thread hanging hook and a driving mechanism for the swing axis need to be placed on the rear left side of the needle drop position, the end portion of the bed becomes larger in diameter and longer to ensure the mount space therefor and may interfere with a sewing operation.

The present invention has been made with the aim of solving the above problems, and it is an object of the present invention to provide a seam ravel preventing apparatus that does not require a large mount space on the end portion of the sewing bed and is applicable to a sewing machine comprising a cylindrical bed by placing the looper thread hanging hook and the driving mechanism thereof together with a cutting mechanism for the looper thread and needle threads on the right side of the needle drop position, and to provide a seam ravel preventing method implemented using this apparatus.

A seam ravel preventing apparatus according to a first aspect of the invention is a seam ravel preventing apparatus for preventing raveling at a sewing end portion of a seam, provided in a sewing machine for forming the seam by passing a looper, which advances from a right side of a needle drop position toward a left side, into loops of needle threads formed on a rear side of the needle drop position and intertwining a looper thread held by the looper with the needle threads, characterized by comprising: a looper thread hanging hook arranged on a right rear side of the needle drop position so that it can advance and retreat for catching the looper thread near an advance end of the looper when advancing to a left forward direction, and holding the looper thread at a position behind the needle drop position when retreating to a right backward direction; a thread cutting hook arranged on a right side of the needle drop position so that it can advance and retreat, and be inserted into the loops of the needle threads where the looper is passed when advancing to a left direction; a first hook section, provided at a tip of the thread cutting hook, for catching the looper thread near a tip of the looper when retreating to a right direction; a second hook section, provided in a middle of the thread cutting hook, for catching the needle threads and the looper thread held by the looper thread hanging hook on the rear side of the needle drop position when retreating to a right direction; a thread cutting knife for cutting the looper thread and needle threads caught by the first and second hook sections by coming into slide-contact with the first and second hook sections near a retreat end of the thread cutting hook; and control means for performing a ravel prevention operation by bringing the looper into an advance state just before an end of sewing, advancing and retreating the looper thread hanging hook to catch the looper thread, performing sewing for at least one stitch in this state, and then advancing and retreating the thread cutting hook to catch the looper thread and needle threads with the first and second hook sections and cut the looper thread and needle threads.

In the first aspect, with the time at which the looper is in the advance state just before the end of sewing as the starting point, the looper thread hanging hook provided on the right rear side of the needle drop position is forced to perform the advance and retreat operation to catch the looper thread near the left advance end of the looper with the advance in the left forward direction and hold the caught looper thread on the rear side of the needle drop position with the retreat to the right rear side. Next, sewing is performed for at least one stitch in this state, the thread cutting hook provided on the right side of the needle drop position is forced to perform the advance and retreat operation so that the thread cutting hook is inserted into the loops of the needle threads where the looper is passed with the advance in the left direction, the looper thread is caught near the left advance end of the looper by the first hook section provided at the tip of the thread cutting hook and the looper thread held by the looper thread hanging hook is caught together with the needle threads by the second hook section provided in the middle of the thread cutting hook with the subsequent retreat to the right direction, and the looper thread and needle threads are cut with the thread cutting knife that successively comes into slide-contact with the second and first hook sections with the further retreat of the thread cutting hook, thereby realizing a ravel preventing state.

A seam ravel preventing apparatus according to a second aspect is characterized in that a driving mechanism for advancing and retreating the looper thread hanging hook according to the first aspect is provided in a sewing bed on the right rear side of the needle drop position together with a guide member for guiding and moving the looper thread hanging hook.

In the second aspect, by providing the driving mechanism for advancing and retreating the looper thread hanging hook from the rear right side of the needle drop position to the left front side obliquely in the sewing bed on the right rear side of the needle drop position together with the guide member for guiding movement, the ravel preventing apparatus is constructed without requiring a large space on the rear side of the needle drop position.

A seam ravel preventing apparatus according to a third aspect is characterized in that the position of holding the looper thread by the looper thread hanging hook according to the first aspect is set at a position lower than the advance and retreat path of the thread cutting hook.

In the third aspect, the looper thread caught by the looper thread hanging hook is held in a position lower than the advance and retreat path of the thread cutting hook on the rear side of the needle drop position, thereby eliminating the interference during the advance operation of the thread cutting hook, and ensuring the catching of the threads by the second hook section during the retreat operation of the thread cutting hook.

A seam ravel preventing apparatus according to a fourth aspect is characterized in that the advance and retreat path of the thread cutting hook according to any one of the first through third aspects is set along an upper position of the advance and retreat path of the looper.

In the fourth aspect, the advance operation and retreat operation of the thread cutting hook after the sewing of at least one stitch is performed along an upper position of the advance and retreat path of the looper, so that the thread cutting hook is certainly inserted into the loops of the needle threads where the looper is passed at the time of advance, and the needle threads are certainly caught by the second hook section at the time of retreat.

A seam ravel preventing apparatus according to a fifth aspect is characterized in that the advance and retreat path of the looper thread hanging hook according to any one of the first through fourth aspects is set so as to cross obliquely the advance and retreat path of the looper from a right rear to left front direction near the advance end of the looper.

In the fifth aspect, the advance and retreat operation of the looper thread hanging hook is performed so that the looper thread hanging hook obliquely crosses the advance and retreat path of the looper near the left advance end of the looper, thereby ensuring the catching of the looper thread with the looper thread hanging hook.

Further, a seam ravel preventing method according to a sixth aspect of the invention is a method for preventing raveling at a sewing end portion of a seam formed by passing a looper, which advances from the right side of a needle drop position toward the left side, into loops of needle threads formed on the rear side of the needle drop position and intertwining a looper thread held by the looper with the needle threads, and characterized in that the method is implemented using a sewing machine comprising a looper thread hanging hook that performs an advance and retreat operation from the right rear side of the needle drop position to a left forward direction and has a holding hook at the tip; a thread cutting hook that performs an advance and retreat operation from the right side of the needle drop position to a left direction and has a first hook section at the tip and a second hook section in the middle; and a thread cutting knife that successively comes into slide-contact with the second hook section and the first hook section when the thread cutting hook retreats, and the method comprises: a first step of bringing the looper into an advance state just before the end of sewing, advancing and retreating the looper thread hanging hook to catch the looper thread held by the looper with the holding hook, and holding the looper thread on the rear side of the needle drop position; a second step of performing sewing for at least one stitch while maintaining the state of the looper thread held in the first step; and a third step of advancing and retreating the thread cutting hook after the sewing in the second step to catch the looper thread and needle threads with the first and second hook sections and cut the looper thread and needle threads by slide-contact with the thread cutting knife.

In the sixth aspect, first, as the first step, when the looper is in the advance state just before the end of sewing, the looper thread hanging hook is advanced and retreated to catch the looper thread near the left advance end of the looper and hold the caught looper on the rear side of the needle drop position. In the next second step, sewing is performed for at least one stitch while maintaining the hold state of the looper thread. In the next third step, the thread cutting hook is advanced and retreated so that the thread cutting hook catches the looper thread near the left advance end of the looper with the first hook section provided at the tip of the thread cutting hook and catches the looper thread held by the looper thread hanging hook together with the needle threads with the second hook section provided in the middle thereof, and the looper thread and needle threads are cut collectively with the thread cutting knife that successively comes into slide-contact with the second and first hook sections, thereby realizing a ravel preventing state.

In the seam ravel preventing apparatus according to the first aspect of the invention and the seam ravel preventing method according to the sixth aspect, in order to prevent raveling, the looper thread hanging hook for temporarily holding the looper thread just before the end of sewing is provided on the right side of the needle drop position together with the thread cutting hook, and a single thread cutting hook having the first hook section and the second hook section is provided to collectively catch and cut the necessary looper thread and needle threads. Thus, since these hooks and the driving mechanisms for them can be placed compactly on the right side of the needle drop position, it is possible to apply this apparatus and method to any kinds of sewing machines, such as a sewing machine including a cylindrical bed in which the mount space is limited, and it is possible to certainly prevent raveling at the seam with a simple operation, and prevent wrinkles on the sewn cloth and poor appearance due to an abnormal seam.

In the seam ravel preventing apparatus according to the second aspect, since the looper thread hanging hook that is provided on the right rear side of the needle drop position and advances and retreats toward the left forward direction is placed inside the sewing bed together with the driving mechanism and guide member, it is possible to construct the apparatus without requiring a large space on the rear side of the bed, and therefore this apparatus is applicable to a sewing machine including a cylindrical bed.

In the seam ravel preventing apparatus according to the third aspect, since the looper thread is held by the looper thread hanging hook at a position lower than the advance and retreat path of the thread cutting hook, there is no possibility of interference when the thread cutting hook advances. Moreover, the held looper thread is certainly caught by the second hook section when the thread cutting hook retreats, and therefore it is possible to stably perform the operation of preventing raveling.

In the seam ravel preventing apparatus according to the fourth aspect, since the thread cutting hook advances and retreats along an upper position of the advance and retreat path of the looper, the advancing thread cutting hook is certainly inserted into the loops of the needle threads where the looper is passed, and the catching of the needle threads during the subsequent retreat is certainly performed, and therefore it is possible to stably perform the operation of preventing raveling.

Further, in the seam ravel preventing apparatus according to the fifth aspect, since the looper thread hanging hook advances and retreats to cross obliquely the tip of the looper located on the left advance end, it is possible certainly catch and hold the looper thread with the looper thread hanging hook, and thus the present invention has advantages effects, such as making it possible to stably perform the operation of preventing raveling.

The above and further objects and features of the invention will more fully be apparent from the following detailed description with accompanying drawings.

DETAILED DESCRIPTION OF THE INVENTION

The following description will explain in detail the present invention, based on the drawings illustrating an embodiment thereof. FIGS. 2 to 5 are plan views showing schematically the structures of essential parts of a seam ravel preventing apparatus according to the present invention (hereinafter referred to as the apparatus of the present invention). Note that the terms "left" and "right" used in the explanation represent the left and right of FIGS. 2 to 6 and the end portion of the sewing bed is the left side.

The apparatus of the present invention is provided in a sewing machine for sewn cloth (not shown) that is fed forward or backward (the direction shown by an open arrow in FIG. 2) with two needles 2 and 2 that move down to separate needle drop positions indicated by A and A, respectively, in FIGS. 2 to 5 (see FIGS. 9 to 13), and a looper 1 that performs an advance and retreat operation including these needle drop positions A and A in the middle thereof. In FIGS. 2 to 5, a sewing bed B and a throat plate C fixed to the upper face of the sewing bed B at an end portion are indicated by alternate long and two short dashes lines, and the needle drop positions A and A are set at substantially the center of the throat plate C.

Figure 2:
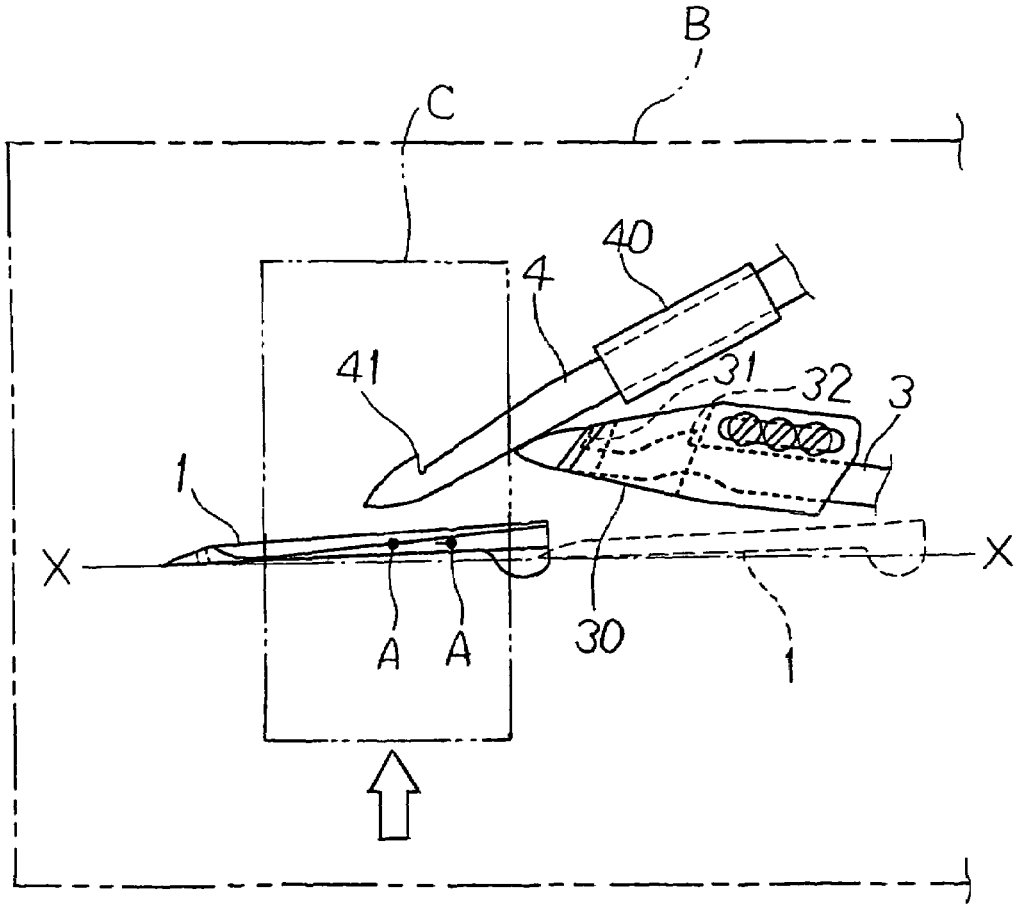
FIG. 2 is a plan view schematically showing the structures of essential parts of an apparatus of the present invention.

With the transmission of movement from the sewing machine main axis (not shown), the looper 1 performs an advance and retreat operation along a path X-X indicated by an alternate long and one short dash line in FIG. 2 between a left advance position where its tip advances beyond the needle drop positions A and A in the left direction as shown by a solid line in FIGS. 2 to 5 and a right retreat position where the tip retreats to the right side of the needle drop positions A and A as shown by a broken line in FIG. 2.

A thread cutting hook 3 is arranged above the looper 1 so that it can advance or retreat in substantially the same direction as the looper 1, and a looper thread hanging hook 4 with a tip pointed obliquely forward is arranged on the rear side of the thread cutting hook 3 and the looper 1 so that it can advance or retreat in a longitudinal direction.

A first hook section 31 in the form of a hook projects backward at the tip portion of the thread cutting hook 3. Similarly, a second hook section 32 in the form of a hook projects backward in the middle portion of the thread cutting hook 3, and the width of the projection position of the second hook section 32 is wider toward the rear side than the projection position of the first hook section 31. Further, one holding hook 41 in the form of a hook is provided at the tip portion of the looper thread hanging hook 4 so that it projects backward.

A thread cutting knife 30 in the form of a flat plate having a blade at the front edge is attached to the thread cutting hook 3 so that it comes into contact from above. The thread cutting knife 30 and the thread cutting hook 3 are attached to a common base (not shown), so that they move between a wait position where the tip of the thread cutting hook 3 is positioned on the rear side of the advance and retreat path of the looper 1 as shown in FIGS. 2 and 3 and an operation position where the tip of the thread cutting hook 3 is positioned above the advance and retreat path of the looper 1 as shown in FIGS. 4 and 5.

Figure 3:
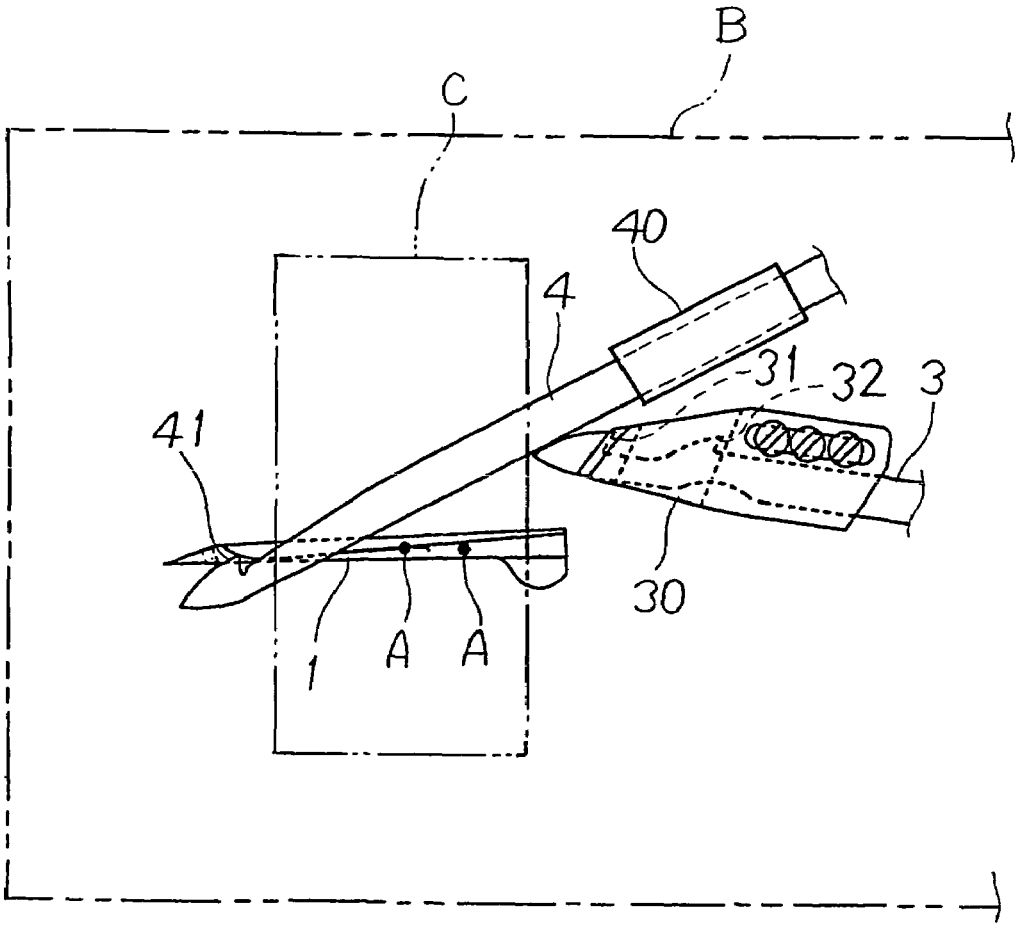
FIG. 3 is a plan view schematically showing the structures of essential parts of the apparatus of the present invention.
Figure 4:
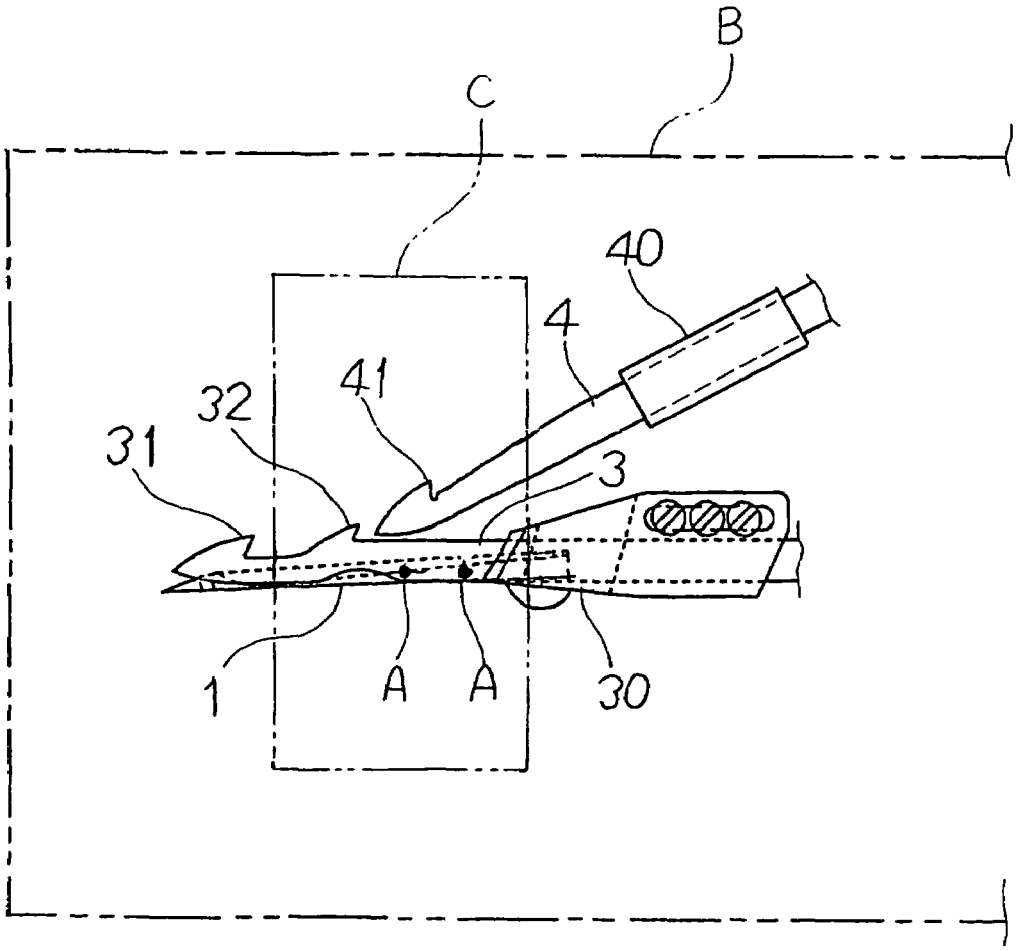
FIG. 4 is a plan view schematically showing the structures of essential parts of the apparatus of the present invention.
Figure 5:
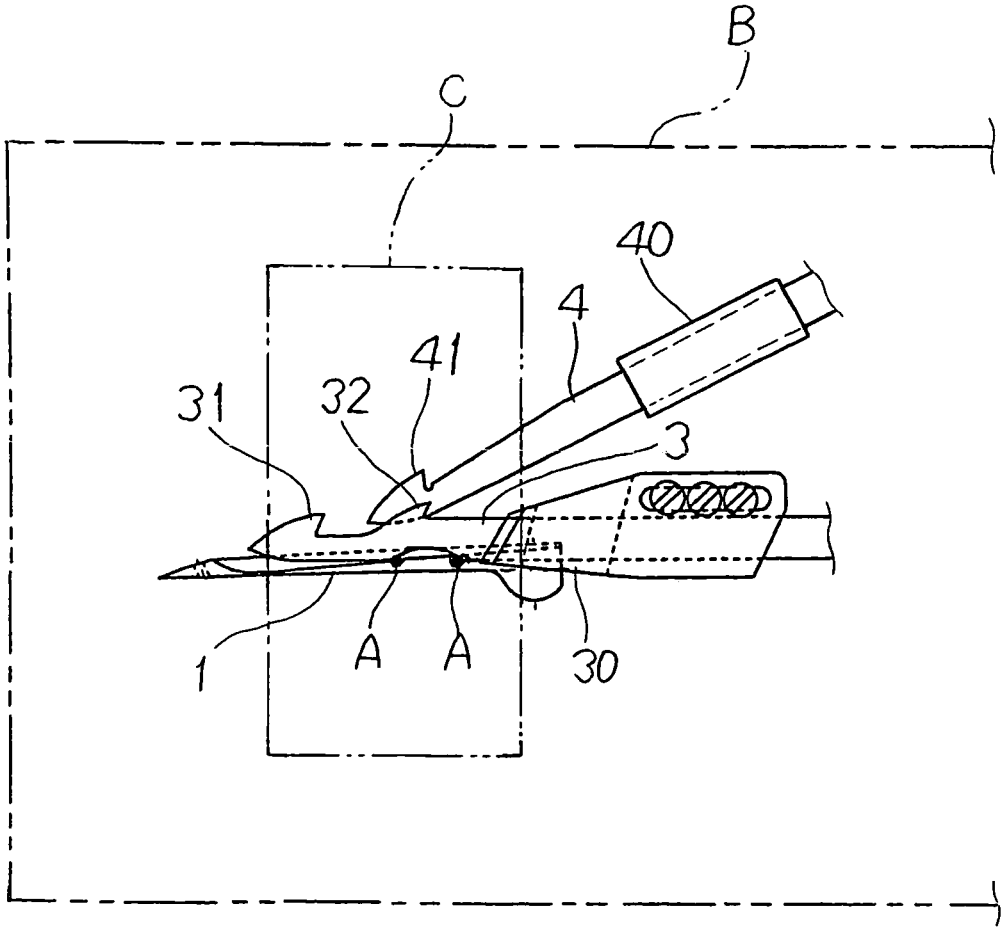
FIG. 5 is a plan view schematically showing the structures of essential parts of the apparatus of the present invention.

The thread cutting hook 3 is forced so that it can advance and retreat along the upper side of the looper 1 with the thread cutting knife 30 as a slide guide during the movement toward the operation position, and the thread cutting hook 3 performs the advance and retreat operation between the retreat position shown in FIGS. 2 and 3 where up to the first hook section 31 at the tip overlaps the lower side of the thread cutting knife 30 and the advance position where the tip of the first hook section 31 reaches the vicinity of the left advance end of the looper 1 and the middle second hook section 32 is located on the left side of the needle drop positions A and A as shown in FIG. 4. Note that the position of the thread cutting hook 3 shown in FIG. 5 is a position in the course of retreat from the advance position (or in the course of advance from the retreat position).

Moreover, the looper thread hanging hook 4 is supported at the middle portion by a guide member 40 fixed inside the sewing bed B, and performs an advance and retreat operation with the guide of the guide member 40. This advance and retreat operation is set to be performed between the retreat position where the tip at which the holding hook 41 is provided is located at a suitable distance behind the advance and retreat path of the looper 1 on the rear side of the needle drop positions A and A as shown in FIG. 2 and the advance position where the tip at which the holding hook 41 is provided crosses obliquely the upper position of the tip of the looper 1 located in the vicinity of the left advance end from the right rear side to the left front side as shown in FIG. 3.

The thread cutting hook 3 and looper thread hanging hook 4 constructed as described above are advanced and retreated as to be described later, and perform an operation to prevent ravel at the sewing end portion of a seam formed on sewn cloth (not shown) by the operations of the looper 1 and needles 2 and 2. In the apparatus of the present invention comprising such a thread cutting hook 3 and a looper thread hanging hook 4, since the thread cutting hook 3 is located on the right side of the needle drop positions A and A and the looper thread hanging hook 4 is arranged on the rear side of the thread cutting hook 3, that is, arranged from the right rear side toward the rear position of the needle drop positions A and A, it is not necessary to ensure a space for mounting the thread cutting hook 3, looper thread hanging hook 4 and the driving mechanisms for them on the left side of the needle drop positions A and A, that is, on the end side of the sewing bed B.

Moreover, since catching and cutting of the needle threads 6*a*, 6*b* and looper thread 7, which are necessary for a later described operation to prevent raveling (see FIGS. 9 to 13), are performed collectively with a single thread cutting hook 3, it is possible to position the looper thread hanging hook 4 adjacently on the rear side of the thread cutting hook 3 within a range in which it is not interfered with the advance and retreat path. It is therefore possible to ensure a mount space for the looper thread hanging hook 4 including the guide member 40 and driving mechanism thereof, without increasing the diameter of the sewing bed B.

Figure 6:
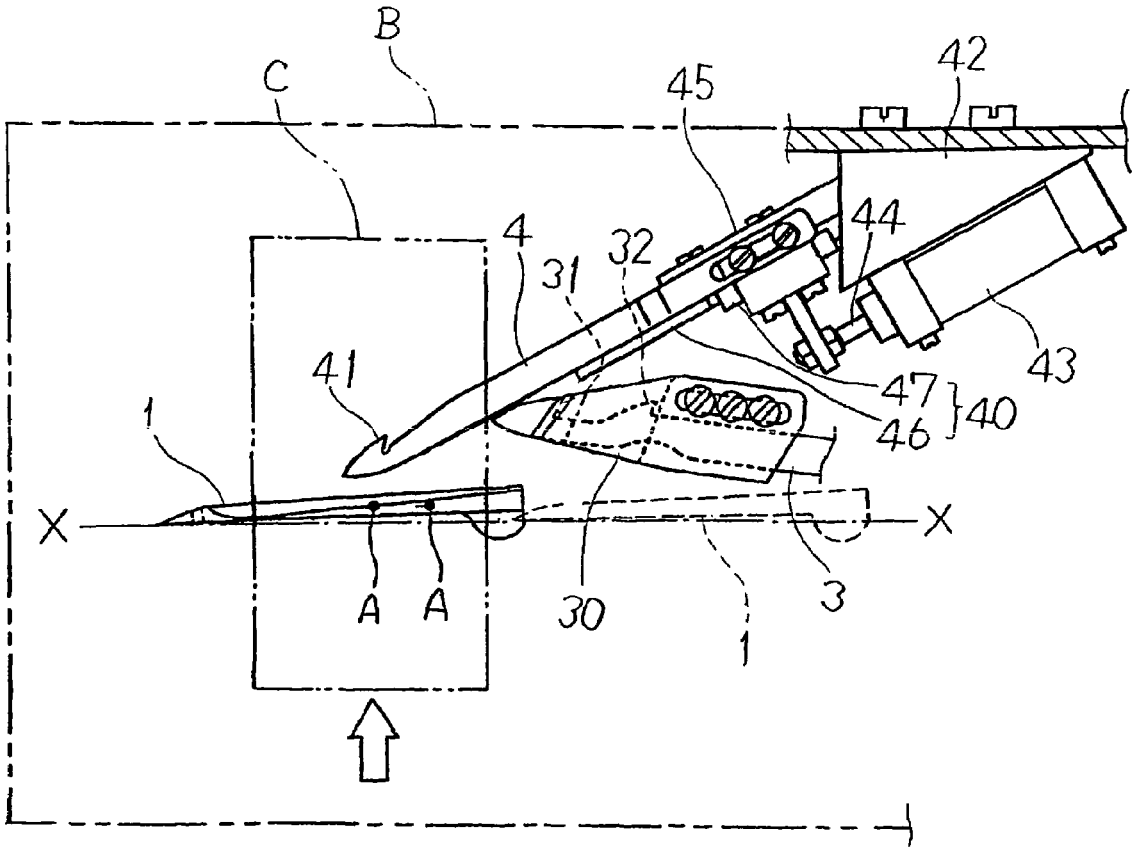
FIG. 6 is a plan view showing a structural example of a driving mechanism for a looper thread hanging hook 4.

FIG. 6 is a plan view showing an example of the structure of the driving mechanism of the looper thread hanging hook 4. The driving mechanism shown in FIG. 6 is constructed such that the looper thread hanging hook 4 including the guide member 40 for guiding the movement thereof is arranged in the cylindrical sewing bed B, and comprises a base 42 fixed to the rear inner face of the sewing bed B, and an air cylinder 43 as a drive source attached to the base 42.

As shown in FIG. 6, the base 42 is a right angled triangle in a plan view, one (long side) of two sides forming a right angle is fixed to the inner face of the sewing bed B, and the other side (short side) is arranged to be pointed to the left. The air cylinder 43 is attached along a slanting side of such a base 42, and comprises an output rod 44 that advances to the left front side and retreats to the right rear side.

Moreover, a guide board 45 extending to a left forward direction substantially parallel to the slanting side is integrally provided to project from the short side of the base 42, and a linear guide 46 is attached along the front face of the guide board 45. The linear guide 46 partly shown in FIG. 6 supports a slider 47 so that the slider 47 can freely slide in a longitudinal direction along the linear guide 46, and the slider 47 is connected to an end of the output rod 44 of the air cylinder 43 through a connection arm projecting forward.

On the upper surface of the slider 47 thus supported, the base section of the looper thread hanging hook 4 is screw fixed so that it is possible to make a position adjustment in a longitudinal direction along a sliding direction of the slider 47 and a slight adjustment of a relative tilt angle with respect to the slider 47. Hence, the linear guide 46 and slider 47 constitute the guide member 40 for moving and guiding the looper thread hanging hook 4, and the looper thread hanging hook 4 is forced to advance to the left or retreat to the right while being moved and guided by the sliding operation of the slider 47 along the linear guide 46, according to the operation of the air cylinder 43 caused as described above.

Thus, in the structural example shown in FIG. 6, the driving mechanism for forcing the looper thread hanging hook 4 to perform the above-mentioned advance and retreat operation can be compactly placed inside the sewing bed B together with the guide member 40 (linear guide 46 and slider 47) for moving and guiding the looper thread hanging hook 4. Hence, since there is no need to ensure a large space on the rear side of the sewing bed B, this structure is applicable to a sewing machine comprising a small-diameter cylindrical bed in which the space is limited, and makes it possible to implement the following ravel preventing method.

In FIG. 6, although the air cylinder 43 is used as the drive source for advancing and retreating the looper thread hanging hook 4, it may be possible to use other drive source capable performing the advance and retreat operation, such as a solenoid. Moreover, needless to say, the structure of the guide member and the connection structure between the guide member and the drive source are not limited to the structures shown in FIG. 6.

Figure 7:
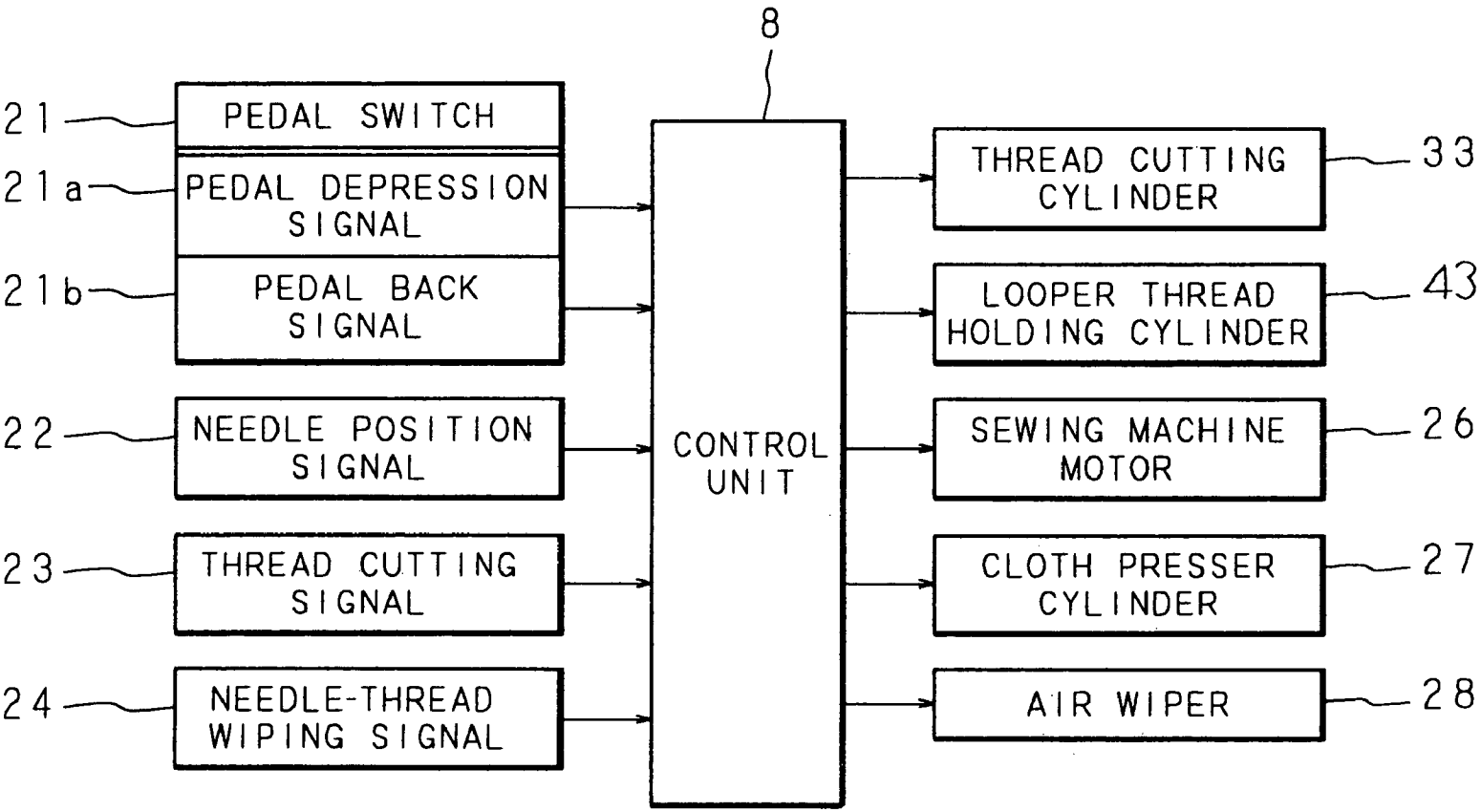
FIG. 7 is a block diagram of a control system of a sewing machine comprising an apparatus of the present invention.

FIG. 7 is a block diagram of a control system of a sewing machine comprising the above-described apparatus of the present invention. A pedal depression signal 21*a* and a pedal back signal 21*b* given by a pedal switch 21, a needle position signal 22 given when the needle is located near the top dead point, and a thread cutting signal 23 and a needle-thread wiping signal 24 given as to be described later are respectively inputted to the control unit 8 constructed using a microprocessor.

On the other hand, an output of the control unit 8 is supplied respectively to a thread cutting cylinder 33 for advancing and retreating the thread cutting hook 3 constituting the apparatus of the present invention, and a looper thread holding cylinder (air cylinder) 43 for advancing and retreating the looper thread hanging hook 4, so that the thread cutting hook 3 and the looper thread hanging hook 4 are forced to advance and retreat as described above according to an operation instruction given to the respective cylinders 33 and 43 from the control unit 8.

Further, an output of the control unit 8 is supplied respectively to a sewing machine motor 26 as a drive source of the sewing machine main axis, a cloth presser cylinder 27 for raising and lowering a presser metal for pressing cloth, and an air wiper 28 for wiping up a needle thread cut as to be described later. The sewing machine motor 26 is driven or suspended according to an operation instruction from the control unit 8, and the cloth presser cylinder 27 and the air wiper 28 are activated according to the operation instruction from the control unit 8.

Figure 8:
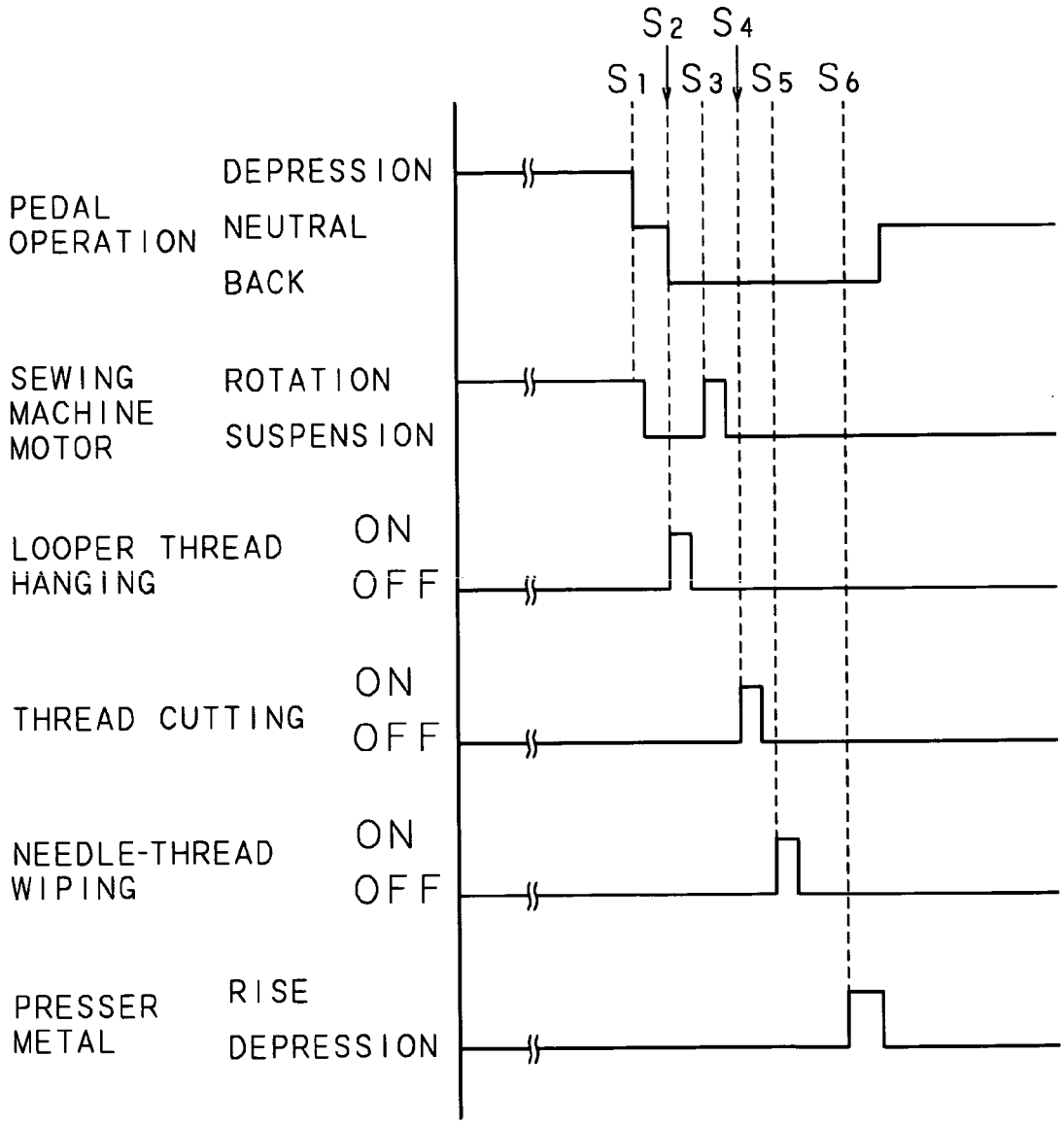
FIG. 8 is a time chart showing the contents of an operation of a control unit.

FIG. 8 is a time chart showing the contents of an operation of the control unit 8 performed to prevent raveling at the sewing end portion of a cloth, not shown, and FIGS. 9 to 13 are explanatory views of the operation of the apparatus of the present invention and show the operation state of the thread cutting hook 3 and looper thread hanging hook 4 between the operations of the control unit 8 in accordance with to the time chart of FIG. 8.

When sewing of the cloth to a required position has been completed and the pedal for driving the sewing machine is returned to a neutral state from a pedal depression state at the time $S_1$ of FIG. 8, that is, when the sewing machine is in a state in which neither the pedal depression signal 21*a* nor the pedal back signal 21*b* is supplied, the control unit 8 gives a suspension instruction to the sewing machine motor 26 on the output side with reference to the needle position signal 22, and temporarily suspends the sewing machine in a state in which the needles 2 and 2 are located near the top dead point and the looper 1 has advanced to the left.

Thereafter, the control unit 8 waits until the pedal back operation of the pedal is performed. At the time $S_2$ of FIG. 8, when the pedal back operation is performed, the control unit 8 performs the following ravel prevention operation for preventing raveling while the pedal back signal 21*b* is being supplied to the input side.

In FIG. 8, although the neutral state is maintained between the time $S_1$ and the time $S_2$, maintaining the neutral state is not an essential operation, and the pedal operation for driving the sewing machine may be performed to move into the pedal back state from the pedal depression state via the neutral position. In this case, a non-signal state in which neither the pedal depression signal 21*a* nor the pedal back signal 21*b* is supplied when passing the neutral position may exist, and the control unit 8 uses such a non-signal state as a trigger and starts the ravel prevention operation after realizing a state in which the needles 2 and 2 are located near the top dead point and the looper 1 has advanced to the left as described above.

Figure 9:
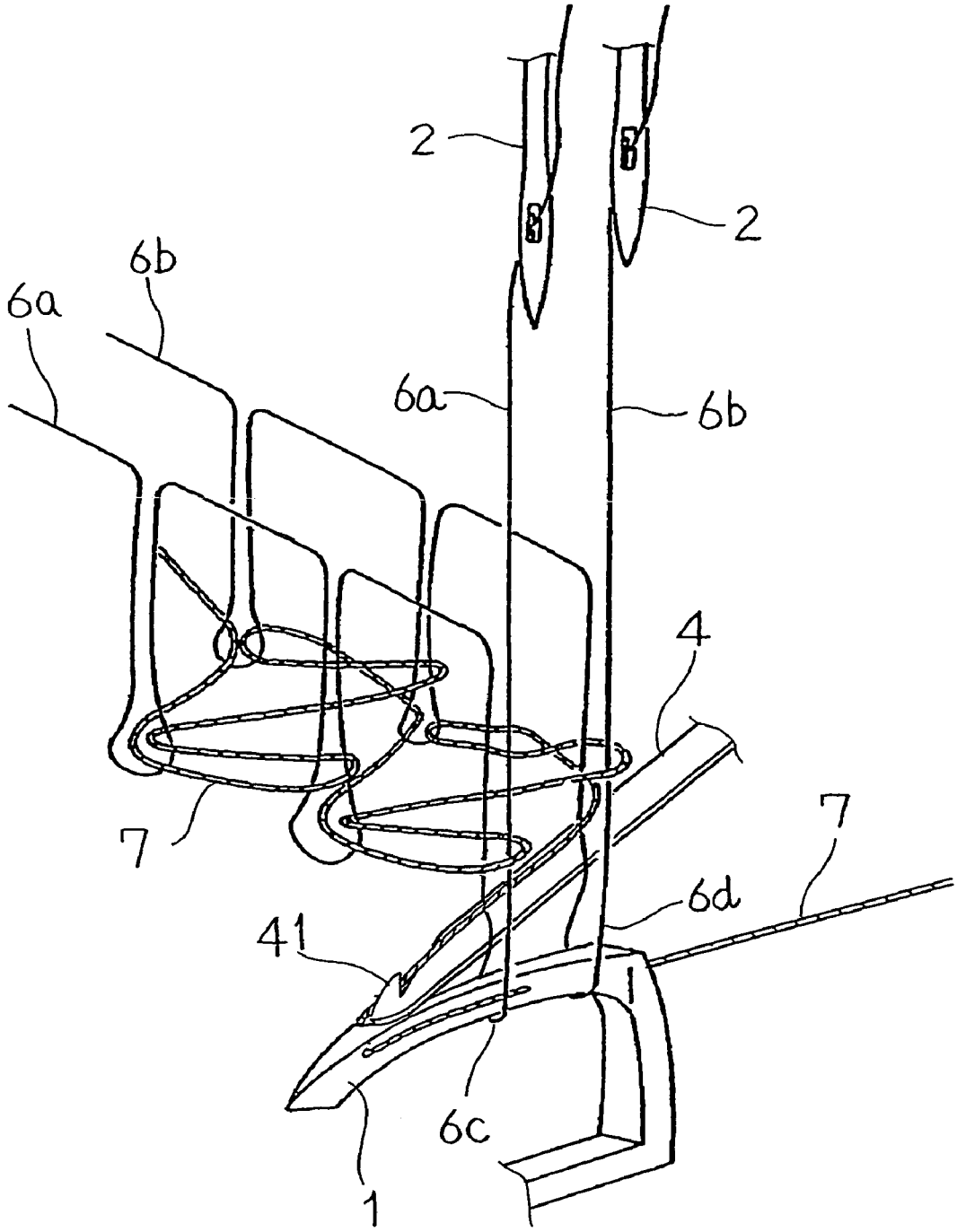
FIG. 9 is an explanatory view of the operation of the apparatus of the present invention.

For the ravel prevention operation, the control unit 8 first gives an operation instruction to the looper thread holding cylinder 43 on the output side to perform the advance and retreat operation for a predetermined stroke. Consequently, the looper thread hanging hook 4 moves from the retreat position shown in FIG. 2 to the advance position shown in FIG. 3, and performs a series of operations to return to the retreat position again. FIG. 9 shows a state in which the looper thread hanging hook 4 is in the course of advancing, or in the course of retreating.

Figure 10:
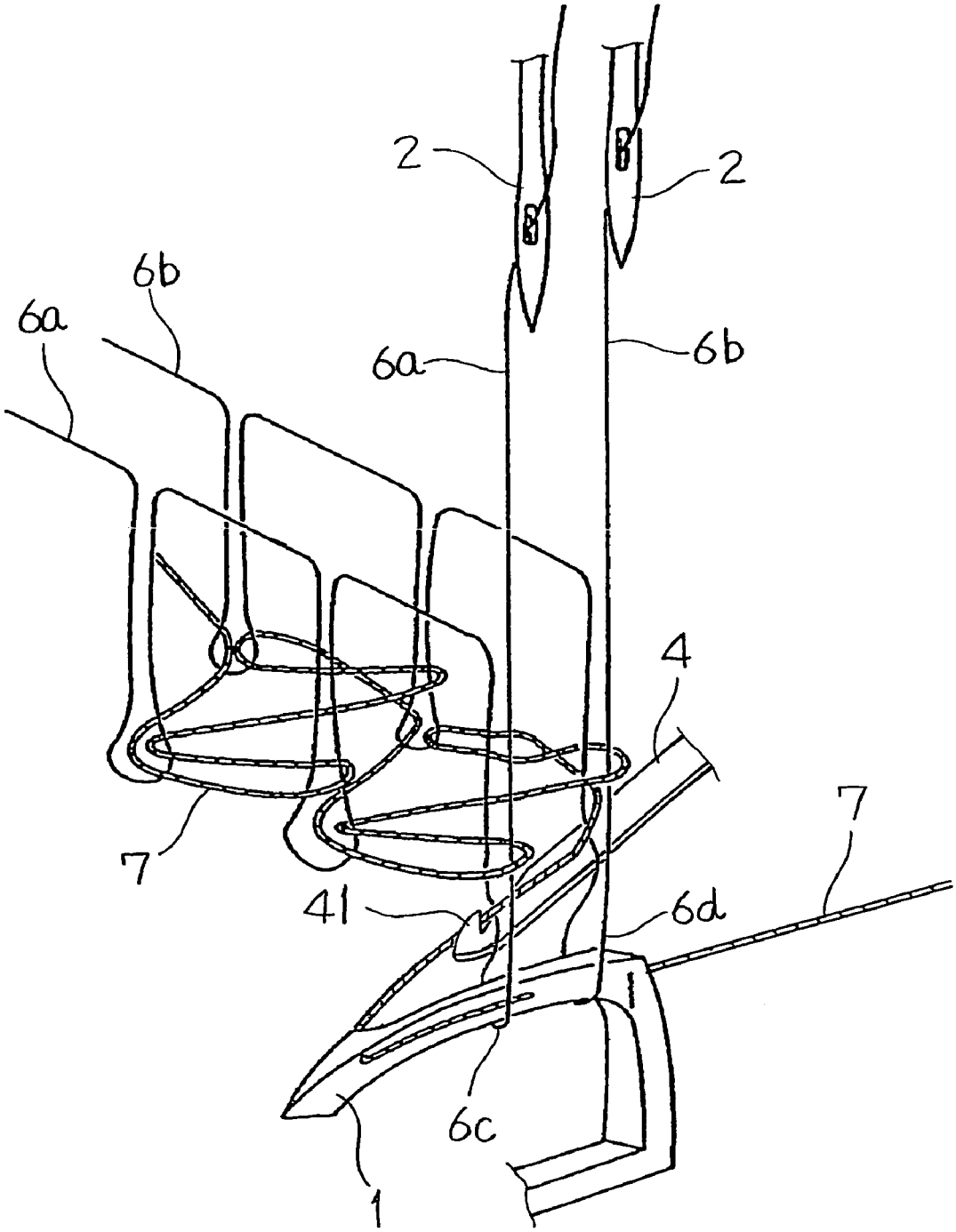
FIG. 10 is an explanatory view of the operation of the apparatus of the present invention.
Figure 11:
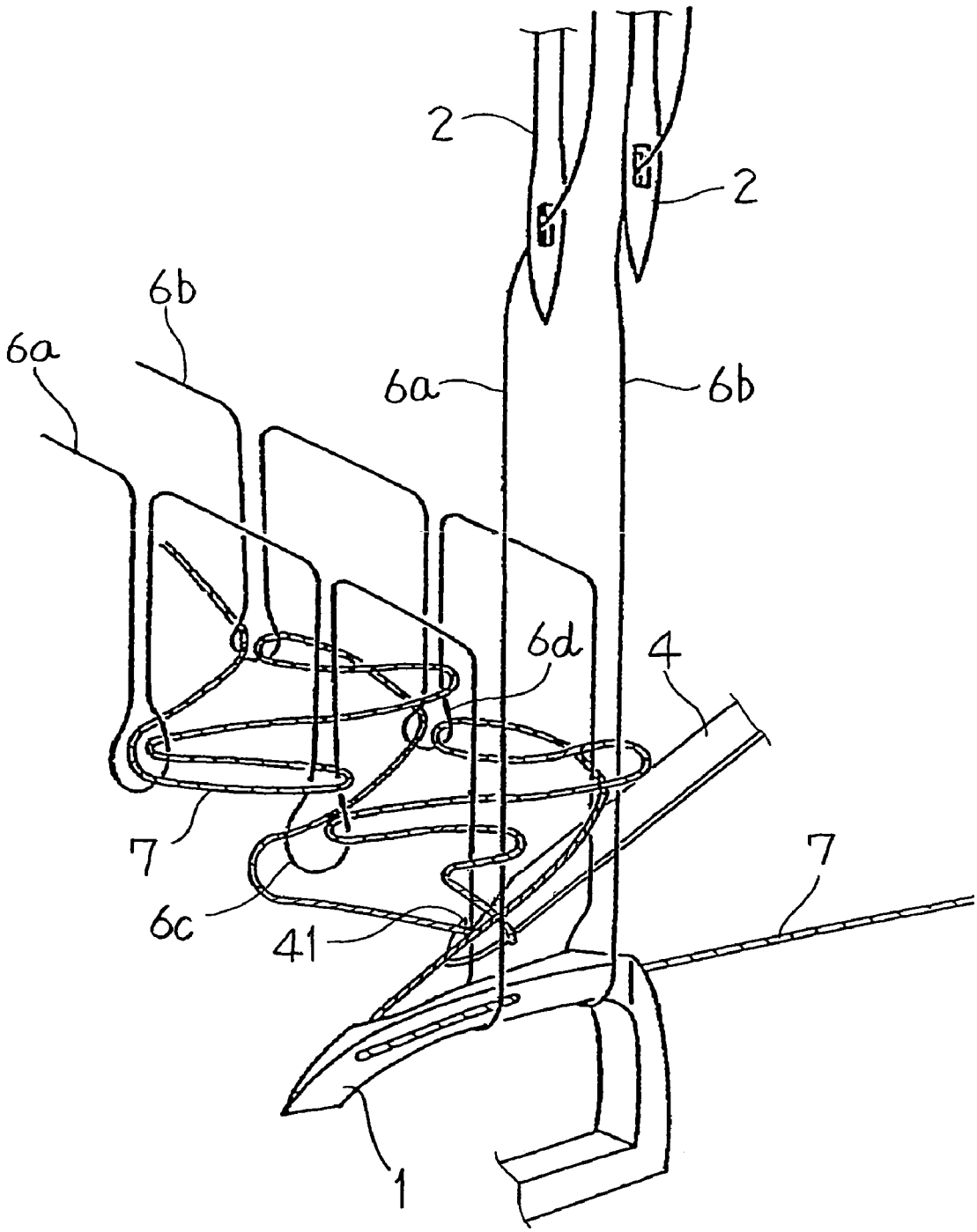
FIG. 11 is an explanatory view of the operation of the apparatus of the present invention.

As described above, the looper thread hanging hook 4 advances to cross obliquely an upper position of the tip of the looper 1 located near the left advance end from the right rear side to left front side, and, as shown in FIG. 9, during the advance operation, the looper thread hanging hook 4 passes behind the final loops 6*c* and 6*d* formed by the two needle threads 6*a* and 6*b* on the back side of the sewn cloth (not shown), and is inserted between the looper 1 and the looper thread 7 running from the tip of the looper 1 to the rear side. When the looper thread hanging hook 4 returns to the retreat position along the same path, the looper thread 7 is caught by the holding hook 41 at the tip of the looper thread hanging hook 4, pulled to the retreat position and retained. In FIG. 10, a state in which the looper thread 7 is retained is shown, and this retaining is performed at a position on the rear side of the needle drop positions A and A, separated by an appropriate distance to the rear side of the advance and retreat path of the looper 1, more specifically at a position shown in FIGS. 4 or 5. The above-mentioned operation is the first step of the seam ravel preventing method according to the present invention.

After advancing and retreating the looper thread hanging hook 4 as described above, the control unit 8 gives an operation instruction to the sewing machine motor 26 on the output side with reference to the needle position signal 22 at the time $S_3$ of FIG. 8 to cause the sewing machine to sew the sewn cloth (not shown) for only one stitch, and suspends the sewing machine again in a state in which the needles 2 and 2 have returned to the vicinity of the top dead point and the looper 1 has returned to the vicinity of the left advance end. At this time, since the above-mentioned one-stitch sewing is performed while the looper thread 7 inserted into the final loops 6*c* and 6*d* of the needle threads 6*a* and 6*b* formed before the first suspension of the sewing machine is being held by the looper thread hanging hook 4, the needle threads 6*a*, 6*b* and the looper thread 7 are in the state shown in FIG. 11. This operation is the second step of the seam ravel preventing method according to the present invention.

Figure 12:
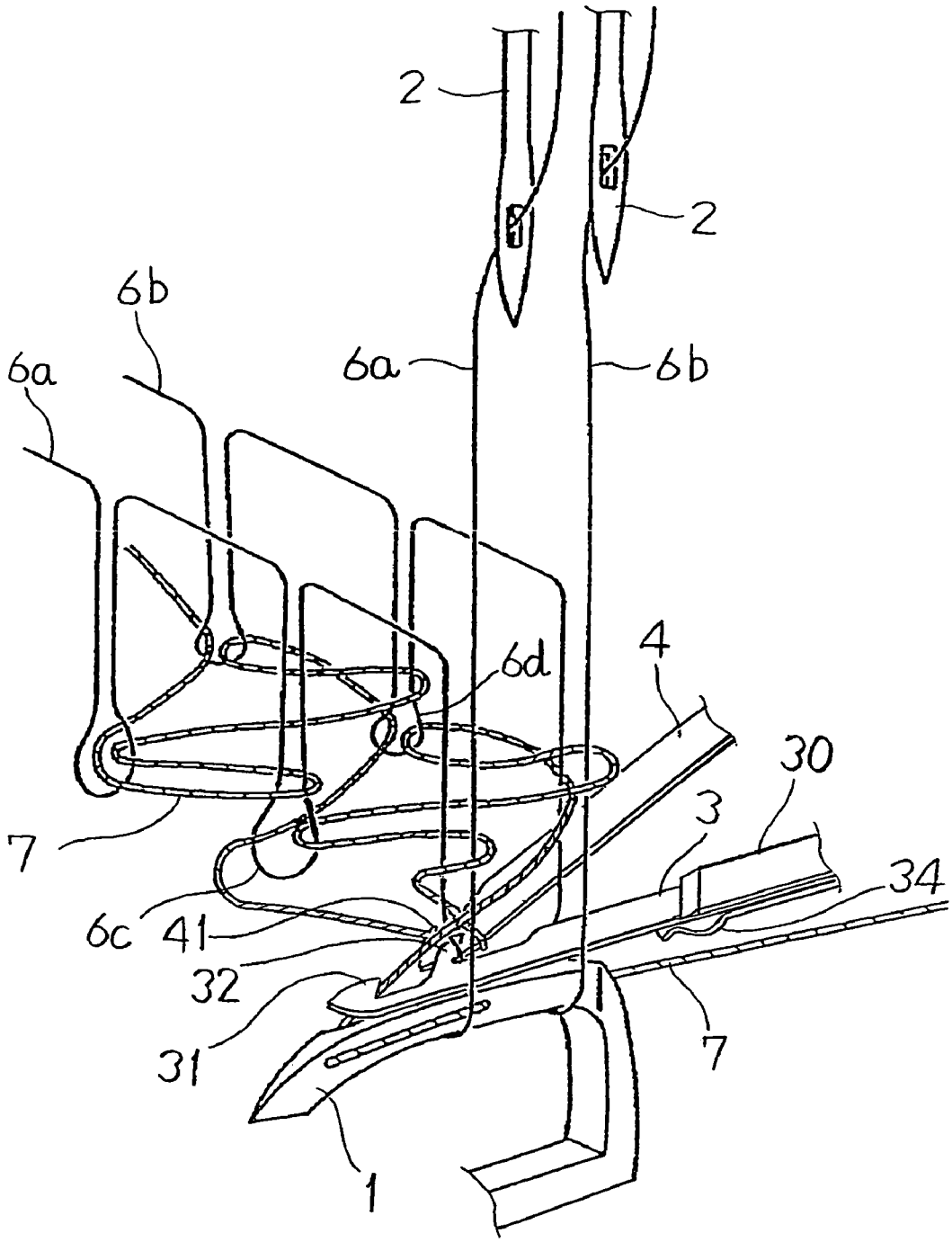
FIG. 12 is an explanatory view of the operation of the apparatus of the present invention.
Figure 13:
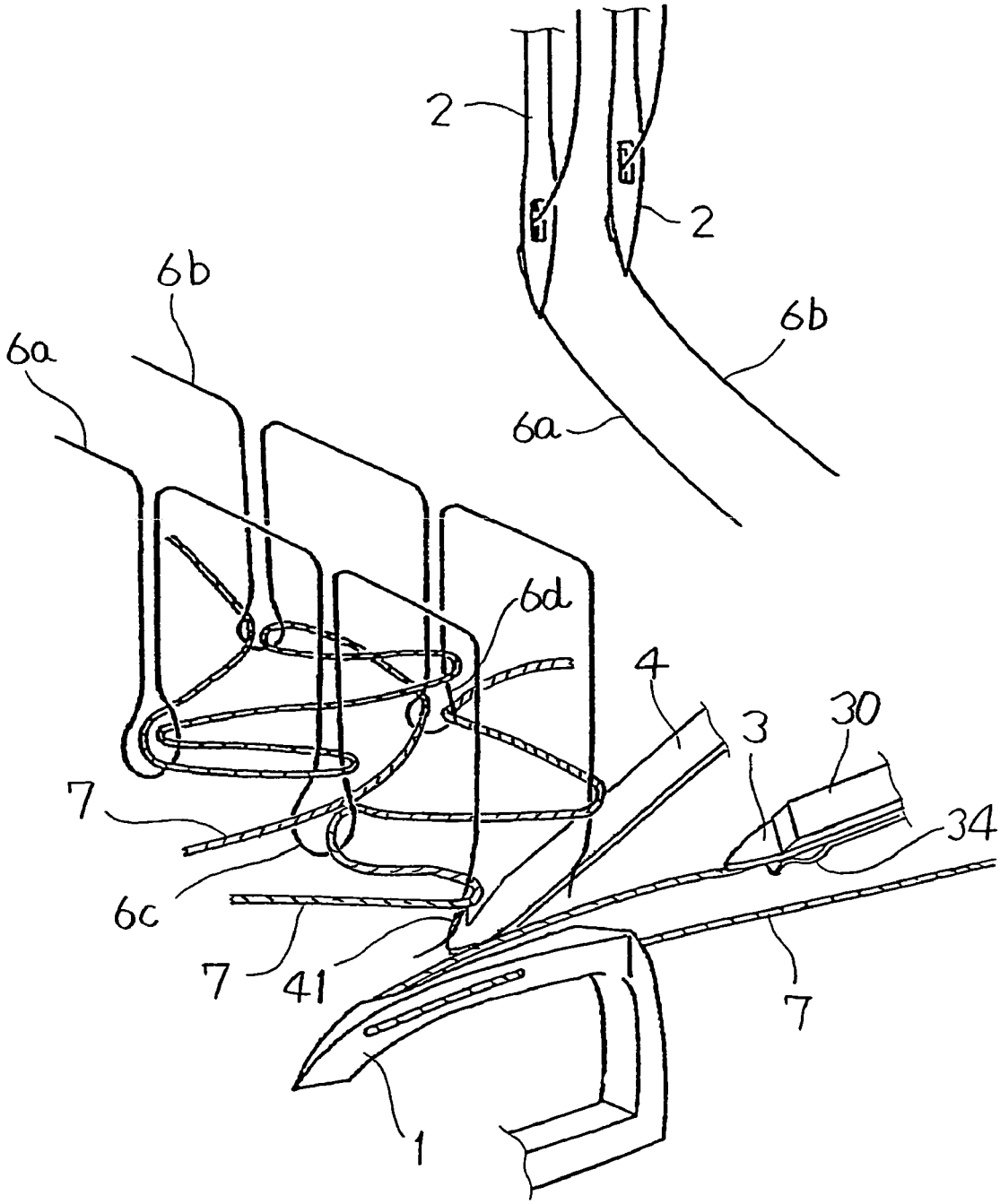
FIG. 13 is an explanatory view of the operation of the apparatus of the present invention.

Next, the control unit 8 waits until the thread cutting signal 23 is given. When the thread cutting signal 23 is given at the time $S_4$ of FIG. 8, the control unit 8 gives an operation instruction to the thread cutting cylinder 33 on the output side, and forces it to perform a predetermined advance and retreat operation. Accordingly, first, the thread cutting hook 3 is moved from the standby position shown in FIG. 2 to the operation position together with thread cutting knife 30, and then advances until it reaches the advance end shown in FIG. 4, and thereafter performs a series of operations to return to the retreat position. FIG. 12 shows a state in the course of advance or retreat of the thread cutting hook 3, and FIG. 13 shows a state in which the thread cutting hook 3 has returned to the retreat position.

As described above, when the advance and retreat operation of the thread cutting hook 3 is performed, the looper 1 holds the loops of the needle threads 6*a* and 6*b* formed by the above-mentioned one-stitch sewing, and the thread cutting hook 3 advancing in the above-mentioned manner is inserted into the loops as shown in FIG. 12. The subsequent retreat of the thread cutting hook 3 is also performed while passing into the loops. Here, since the advance and retreat operation of the thread cutting hook 3 is performed along the upper position of the advance and retreat path of the looper 1, the insertion into the loops of the needle threads 6*a* and 6*b* is certainly performed.

The advance end of the thread cutting hook 3 is set as shown in FIG. 4, so that the first hook section 31 at the tip reaches the vicinity of the left advance end of the looper 1 and the middle second hook section 32 is positioned on the left side of the needle drop positions A and A, and the retreat of the thread cutting hook 3 is started from this position. Here, since the first and second hook sections 31 and 32 of the thread cutting hook 3 project backward at the respective positions as described above, when the thread cutting hook 3 is retreated, the first hook section 31 at the tip catches the looper thread 7 running from the tip to the rear side of the looper 1 positioned on the further retreated side, while the middle second hook section 32 catches the needle threads 6*a* and 6*b* positioned on the rear side of the retreat path and also catches the looper thread 7 held by the looper thread hanging hook 4 on the rear side of the needle threads 6*a* and 6*b*, that is, the looper thread 7 pulled out by the looper 1 when sewing the previous one stitch.

The looper thread 7 caught by the first hook section 31 as described above, the needle threads 6*a* and 6*b* caught by the second hook section 32, and the looper thread 7 in the previous one stitch are pulled to the retreat position of the thread cutting hook 3, and the needle threads 6*a*, 6*b* and the looper thread 7 in the previous one stitch caught by the second hook section 32 are brought into slide-contact with the blade section at the edge of the thread cutting knife 30 and cut. Moreover, the looper thread 7 in one stitch after, which is caught by the first hook section 31, is similarly brought into slide-contact with the blade section at the edge of the thread cutting knife 30 and cut, and held on the looper 1 side than this cutting position.

As shown in FIGS. 9 to 13, the thread cutting hook 3 is pressed at the slide contact section with respect to the thread cutting knife 30 by a spring force of a plate spring 34 that comes into resiliently contact with the front side of the lower surface of the thread cutting hook 3, and the cutting of the needle threads 6*a*, 6*b* and looper thread 7 by the thread cutting knife 30 is performed under the pressure of the plate string 34, and the looper thread 7 caught by the first hook section 31 at this time is held in a state being sandwiched between the lower surface of the thread cutting hook 3 and the plate spring 34.

FIG. 13 shows the state at this time, and the upstream side portion of the looper thread 7 cut at the position caught by the second hook section 32 is intertwined in an interlacing manner in the final loops 6*c* and 6*d* of the needle threads 6*a* and 6*b* formed before the first suspension of the sewing machine, and the portion at the downstream side of this cut position and cut at the position caught by the first hook section 31 remains in a state being inserted in the final loops 6*c* and 6*d*. The above-mentioned operation is the third step of the seam ravel preventing method according to the present invention.

Figure 1A:
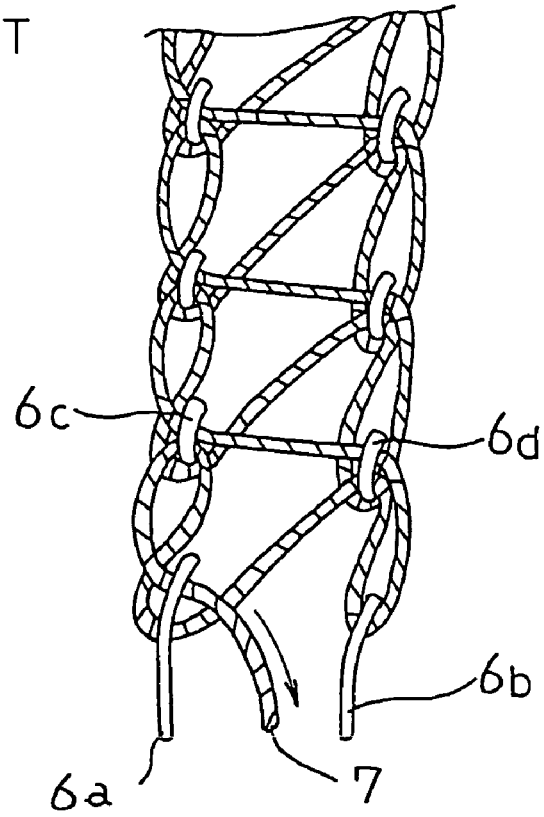
FIG. 1A PRIOR ART
FIGS. 1A and 1B are views showing a general seam at the sewing end portion and a seam at the sewing end portion obtained by a conventional ravel preventing apparatus from the back side of sewn cloth.
Figure 1B:
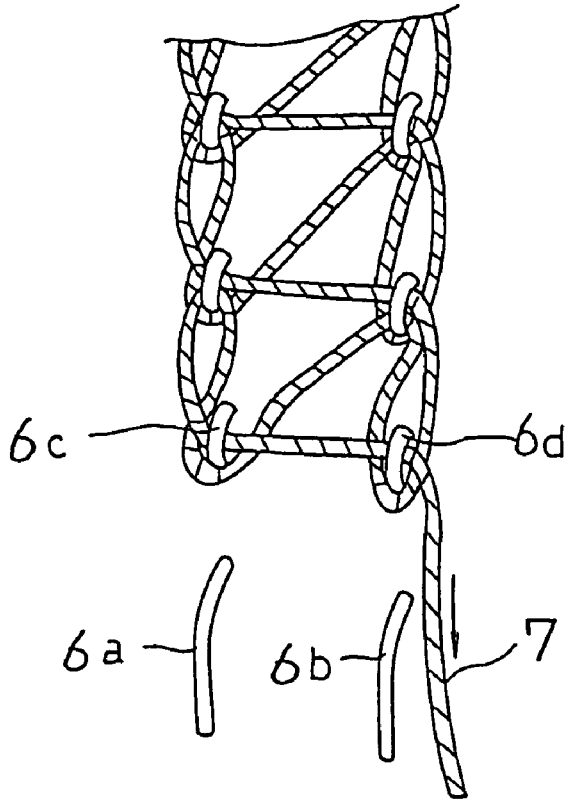
Figure 14:
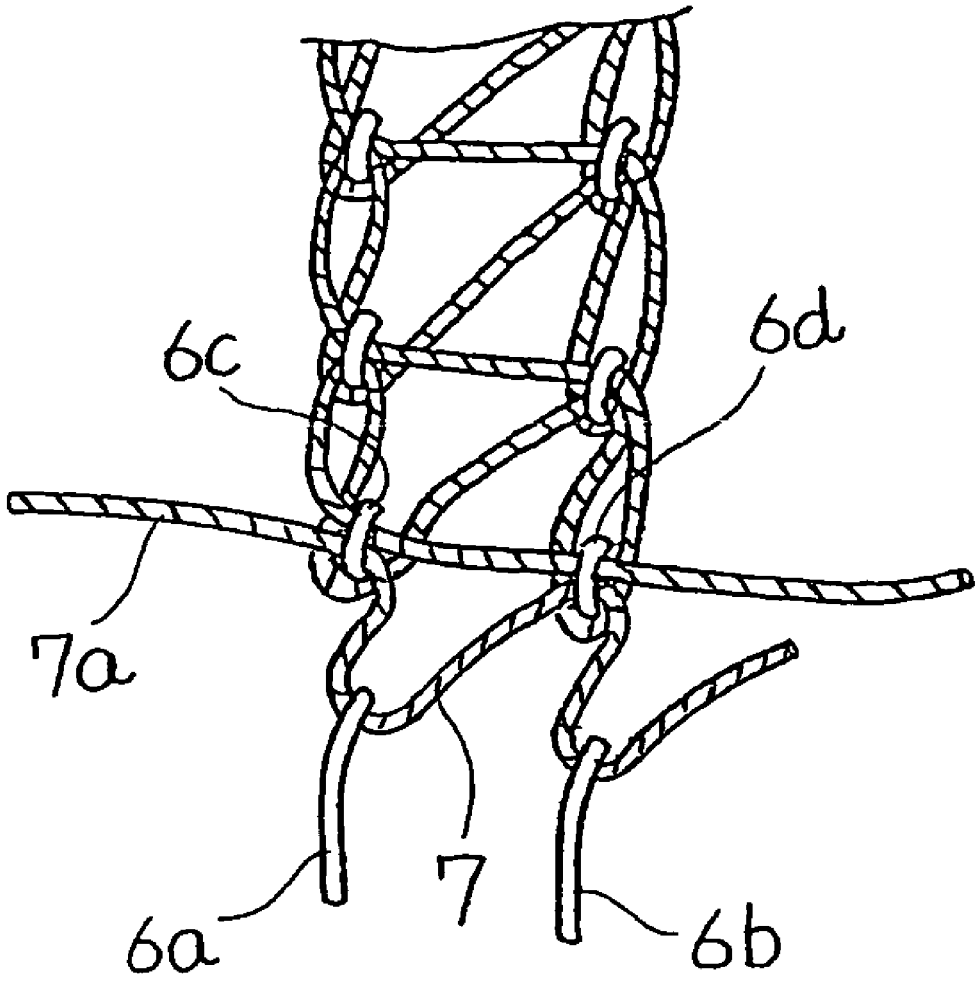
FIG. 14 is a view showing a seam at the sewing end portion obtained by the apparatus of the present invention from the back side of sewn cloth.

FIG. 14 is a view showing a seam at the sewing end portion obtained by the apparatus of the present invention from the back side of sewn cloth. The seam shown in FIG. 14 is the same as the seam shown in FIG. 1B, except that a thread piece 7*a* of the looper thread 7 remaining after being cut at the two positions exists in a state being inserted in the final loops 6*c* and 6*d*. The looper thread 7 intertwined in an interlacing manner with the loops 6*c* and 6*d* will not slip out from the final loops 6*c* and 6*d* when its end is pulled, thereby certainly preventing raveling of the seam at the stage of occurrence.

The thread piece 7*a* may be removed manually by an operator after the completion of sewing, but even when the thread piece 7*a* is left as it is, it will naturally slip off at the stage of using the sewn cloth. The seam at the sewing end portion thus obtained does not differ from other portion in appearance, and therefore does not deteriorate the appearance.

In the above-described embodiment, after catching the looper thread 7 by the looper thread hanging hook 4, sewing for one stitch is performed in this state. However, it is possible to obtain the same ravel prevention effect even by performing sewing for two stitches, or three or more stitches, after catching the looper thread 7. Such sewing is realized by driving the sewing machine motor 26 at the time $S_3$ of FIG. 8 for two stitches, or three or more stitches.

After finishing the above-mentioned cutting operation, the control unit 8 waits until the needle thread wiping signal 24 is given. At the time $S_5$ of FIG. 8, when the needle thread wiping signal 24 is given, the control unit 8 gives an operation instruction to the air wiper 28 on the output side and operates the air wiper 28 to wipe up the needle threads 6*a* and 6*b* remaining on the needles 2 and 2 side onto the sewing bed B. Thereafter, the control unit 8 gives an operation instruction to the cloth presser cylinder 27 on the output side at the time $S_6$ of FIG. 8, operates the cloth presser cylinder 27 to raise the presser metal (not shown) for pressing cloth, and finishes a series of operations for preventing raveling.

Thus, it becomes possible to remove the sewn cloth from the sewing machine and set a new sewn cloth. The looper thread 7 left on the looper 1 side at this time is held by the first hook section 31 at the tip of the thread cutting hook 3 and the thread cutting knife 30, and the needle threads 6*a* and 6*b* left on the needles 2 and 2 side are in a state of having been wiped up to the sewing bed B. It is therefore possible to start the next sewing without requiring any work for these needle threads 6*a*, 6*b* and looper thread 7.

Note that the wiping up of the needle threads 6*a* and 6*b* by the operation of the air wiper 28 and the raising of the presser metal by the operation of the cloth presser cylinder 27 are not essential operations for preventing raveling, and they may be performed according to a separate operation, instead of being performed as a series of operations illustrated in this embodiment.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A seam ravel preventing apparatus for preventing raveling at a sewing end portion of a seam, provided in a sewing machine for forming the seam by passing a looper, which advances from a right side of a needle drop position toward a left side, into loops of needle threads formed on a rear side of the needle drop position and intertwining a looper thread held by the looper with the needle threads, comprising:

a looper thread hanging hook arranged on a right rear side of the needle drop position so that it can advance and retreat for catching the looper thread near an advance end of the looper when advancing to a left forward direction, and holding the looper thread at a position behind the needle drop position when retreating to a right backward direction;

a thread cutting hook arranged on a right side of the needle drop position so that it can advance and retreat, and be inserted into the loops of the needle threads where the looper is passed when advancing to a left direction;

a first hook section, provided at a tip of the thread cutting hook, for catching the looper thread near a tip of the looper when retreating to a right direction;

a second hook section, provided in a middle of the thread cutting hook, for catching the needle threads and the looper thread held by the looper thread hanging hook on the rear side of the needle drop position when retreating to the right direction;

a thread cutting knife for cutting the looper thread caught by the first hook section, and the looper thread and needle threads caught by the second hook section by coming into slide-contact with the first and second hook sections near a retreat end of the thread cutting hook; and a control unit for performing a ravel prevention operation by bringing the looper into an advance state just before an end of sewing, advancing and retreating the looper thread hanging hook to catch the looper, performing sewing for at least one stitch in this state, and then advancing and retreating the thread cutting hook to catch the looper thread with the first hook section, catch the looper thread and needle threads with the second hook section, and cut the threads respectively.

2. The seam ravel preventing apparatus according to claim 1, further comprising:

a driving mechanism for advancing and retreating said looper thread hanging hook; and a guide member for guiding and moving said looper thread hanging hook, wherein said driving mechanism is provided in a sewing bed on a right rear side of the needle drop position together with said guide member.

3. The seam ravel preventing apparatus according to claim 1, wherein the holding position of the looper thread by said looper thread hanging hook is set at a position lower than an advance and retreat path of said thread cutting hook.

4. The seam ravel preventing apparatus according to claim 1, wherein an advance and retreat path of said thread cutting hook is set along an upper position of an advance and retreat path of said looper.

5. The seam ravel preventing apparatus according to claim 1, wherein an advance and retreat path of said looper thread hanging hook is set to cross obliquely an advance and retreat path of said looper from a right rear to left front direction near an advance end of said looper.

6. A method for preventing raveling at a sewing end portion of a seam formed by passing a looper, which advances from a right side of a needle drop position toward a left side, into loops of needle threads formed on a rear side of the needle drop position and intertwining a looper thread held by the looper with the needle threads, wherein said method is implemented using a sewing machine comprising a looper thread hanging hook that performs an advance and retreat operation from a right rear side of the needle drop position to a left forward direction and has a holding hook at a tip; a thread cutting hook that performs an advance and retreat operation from a right side of the needle drop position to a left direction and has a first hook at a tip and a second hook in a middle; and a thread cutting knife that successively comes into slide-contact with the second hook section and the first hook section when the thread cutting hook retreats, and said method comprises:

a first step of bringing the looper into an advance state just before an end of sewing, advancing and retreating the looper thread hanging hook to catch the looper thread held by the looper with the holding hook, and holding the looper thread on the rear side of the needle drop position;

a second step of performing sewing for at least one stitch while maintaining the state of the looper thread held in the first step; and a third step of advancing and retreating the thread cutting hook after the sewing in the second step to catch the looper thread with the first hook section and catch the looper and needle threads with the second hook section and cut the looper thread and needle threads by slide-contact with the thread cutting knife.

* * * * *

UNITED STATES PATENT AND TRADEMARK OFFICE

CERTIFICATE OF CORRECTION

PATENT NO. : 7,497,177 B2
APPLICATION NO. : 11/398652
DATED : March 3, 2009
INVENTOR(S) : Yoshiyuki Tanaka et al.

It is certified that error appears in the above-identified patent and that said Letters Patent is hereby corrected as shown below:

In Column 13, Claim 1

On line 19, "thread hanging hook to catch the looper, performing"

should read

--thread hanging hook to catch the looper thread, performing--

Signed and Sealed this

Sixth Day of April, 2010

David J. Kappos

David J. Kappos
*Director of the United States Patent and Trademark Office*